US011523713B2

(12) United States Patent
Rodenberger

(10) Patent No.: US 11,523,713 B2
(45) Date of Patent: Dec. 13, 2022

(54) FOOT MAT

(71) Applicant: Michael Rodenberger, Palm Harbor, FL (US)

(72) Inventor: Michael Rodenberger, Palm Harbor, FL (US)

( * ) Notice: Subject to any disclaimer, the term of this patent is extended or adjusted under 35 U.S.C. 154(b) by 0 days.

(21) Appl. No.: 15/668,349

(22) Filed: Aug. 3, 2017

(65) Prior Publication Data

US 2022/0330762 A1 Oct. 20, 2022

Related U.S. Application Data

(60) Provisional application No. 62/372,710, filed on Aug. 9, 2016.

(51) Int. Cl.
*A47K 3/00* (2006.01)

(52) U.S. Cl.
CPC ..... *A47K 3/002* (2013.01)

(58) Field of Classification Search
CPC ..... A47K 3/002
USPC ..... 4/582
See application file for complete search history.

(56) References Cited

U.S. PATENT DOCUMENTS

| | | | | |
|---|---|---|---|---|
| 6,707,386 | B1 * | 3/2004 | Pruisner | G08B 21/22 702/41 |
| D623,975 | S * | 9/2010 | Woods | D6/583 |
| 10,639,073 | B1 * | 5/2020 | Serna | A61B 17/54 |
| 2007/0258255 | A1 * | 11/2007 | Kessler | A47L 23/266 362/487 |
| 2013/0086740 | A1 * | 4/2013 | Thompson | A47K 3/002 4/581 |
| 2014/0375434 | A1 * | 12/2014 | Puljan | G09F 13/04 340/12.5 |

* cited by examiner

*Primary Examiner* — Huyen D Le
(74) *Attorney, Agent, or Firm* — Lance C. Venable; The Law Office of Lance C. Venable, PLLC

(57) ABSTRACT

A foot mat is a mat for placing on the bottom of a bathtub or shower to prevent the user slipping and falling, and having a second and third function of vibrating to provide foot massage automatically when the user stands on the mat, and an abrasive edge such as a loofah sponge for exfoliating the contactable surfaces of the feet.

15 Claims, 3 Drawing Sheets

FOOT MAT

CROSS-REFERENCE TO RELATED APPLICATION

The present application is related to and claims priority from prior provisional application Ser. No. 62/372,710, filed Aug. 9, 2016 which application is incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

BACKGROUND OF THE INVENTION

The following includes information that may be useful in understanding the present inventions.) It is not an admission that any of the information provided herein is prior art, or material, to the presently described or claimed inventions, or that any publication or document that is specifically or implicitly referenced is prior art.

1. Field of the Invention

The present invention relates generally to the field of bath mats and more specifically relates to foot mat.

2. Description of the Related Art

Bath mats are used in bath tubs and showers to keep people from slipping while bathing or showering Bath mats come in various thickness, sizes, shapes, and colors, but they generally provide padding for the feet while preventing slippage while standing on wet surfaces. Mats are typically used by people of all ages but tend to be used more by the older generations.

It is also difficult for some people such as the elderly, obese people, or people with back problems, to bend and wash their feet, which may lead to increased chances of getting certain conditions of the feet such as foot odor, athlete's foot, toenail fungi or diabetic foot ulcers. Mats are handy to prevent slippage, but tend to be for a single purpose. A need exists for a dual purpose bath and shower mat which prevents slippage and is able to scrub and massage the users feet while the user is in a standing position.

Various attempts have been made to solve the above-mentioned problems such as those found in U.S. Pat. No. 8,545,516 to Harvey B Hiteshew; U.S. Pat. No. 5,293,660 to Jai H. Park; and U.S. Pat. No. 5,575,034 to Robert D. Biernacinski. This art is representative of bath mats. None of the above inventions and patents, taken either singly or in combination, is seen to describe the invention as claimed.

Ideally, a bath mat should provide slippage prevention and foot massage, and yet, would operate reliably and be manufactured at a modest expense. Thus, a need exists for a reliable foot mat to avoid the above-mentioned problems.

BRIEF SUMMARY OF THE INVENTION

In view of the foregoing disadvantages inherent in the known bath mat art, the present invention provides a novel foot mat. The general purpose of the present invention, which will be described subsequently in greater detail, is to provide slippage prevention and foot massage.

The foot mat for use in a tub or shower may comprise a bottom layer including a vibrator member embedded within and adapted to vibrate the bottom layer, an embedded power source that is electrically connected to and adapted to power the vibrator member, an aperture adapted to allow water to pass therethrough, a top surface including a first connector member, and a bottom surface adapted to releasable engage with a surface of the tub or shower. The bottom layer is sized and shaped and adapted to be releasable engaged with the surface of the tub or shower and to allow water to pass through the aperture and into a drain hole.

The top layer includes a top surface including ridges thereon adapted to provide friction between the top surface and a user's feet, and an aperture therethrough adapted to align with the aperture of the bottom layer and allow water to pass therethrough. The bottom surface includes a second connector member adapted to releasable connect with the first connector member of the bottom layer and the top layer is adapted to removable connect with and cover the bottom layer.

The first and second connector members may be formed from respective hook and loop material. The top layer may be formed from a sponge material but may be formed from a loofah material in alternate embodiments. The bottom surface of the bottom layer includes at least one suction cup thereon adapted to releasable engage with the surface of the tub or shower. The top layer and the bottom layer are formed from a waterproof material.

The top layer further includes a back edge portion extending upwards therefrom and including a material adapted to create friction between the back edge portion and a user's foot, such that the back edge portion is adapted to scrape of layers of dirt or loose skin flakes from the user's foot. The material of the back edge portion may be pumice stone.

The power source may be formed as rechargeable batteries and the bottom layer may include a power supply port electrically connected to the rechargeable batteries and adapted to releasable connect to an external power source. The bottom layer further includes a pressure sensor member embedded therein and electrically connected between the vibrator member and the power source and is adapted to automatically turn on or off the vibrator member when a user is standing upon the foot mat.

The top layer and the bottom layer may be formed from rubber and the first and second connector members may be formed from magnets. The top layer and the bottom layer are formed having a curved portion on respective proximal edges and on respective distal edges thereof in proximity to the respective apertures.

The present invention holds significant improvements and serves as a foot mat. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and methods) of use for the present invention, foot mat, constructed and operative according to the teachings of the present invention.

The various embodiments of the present invention will hereinafter be described in conjunction with the appended drawings, wherein like designations denote like elements.

DETAILED DESCRIPTION

As discussed above, embodiments of the present invention relate to a bath mats and more particularly to a foot mat as used to improve the slippage prevention while providing foot massage.

Generally speaking, a foot mat is a mat for placing on the bottom of a bathtub or shower to prevent the user slipping and falling, and having a second and third function of vibrating to provide foot massage automatically when the user stands on the mat, and an abrasive edge such as a loofah sponge for exfoliating the contactable surfaces of the feet.

Figure 1:
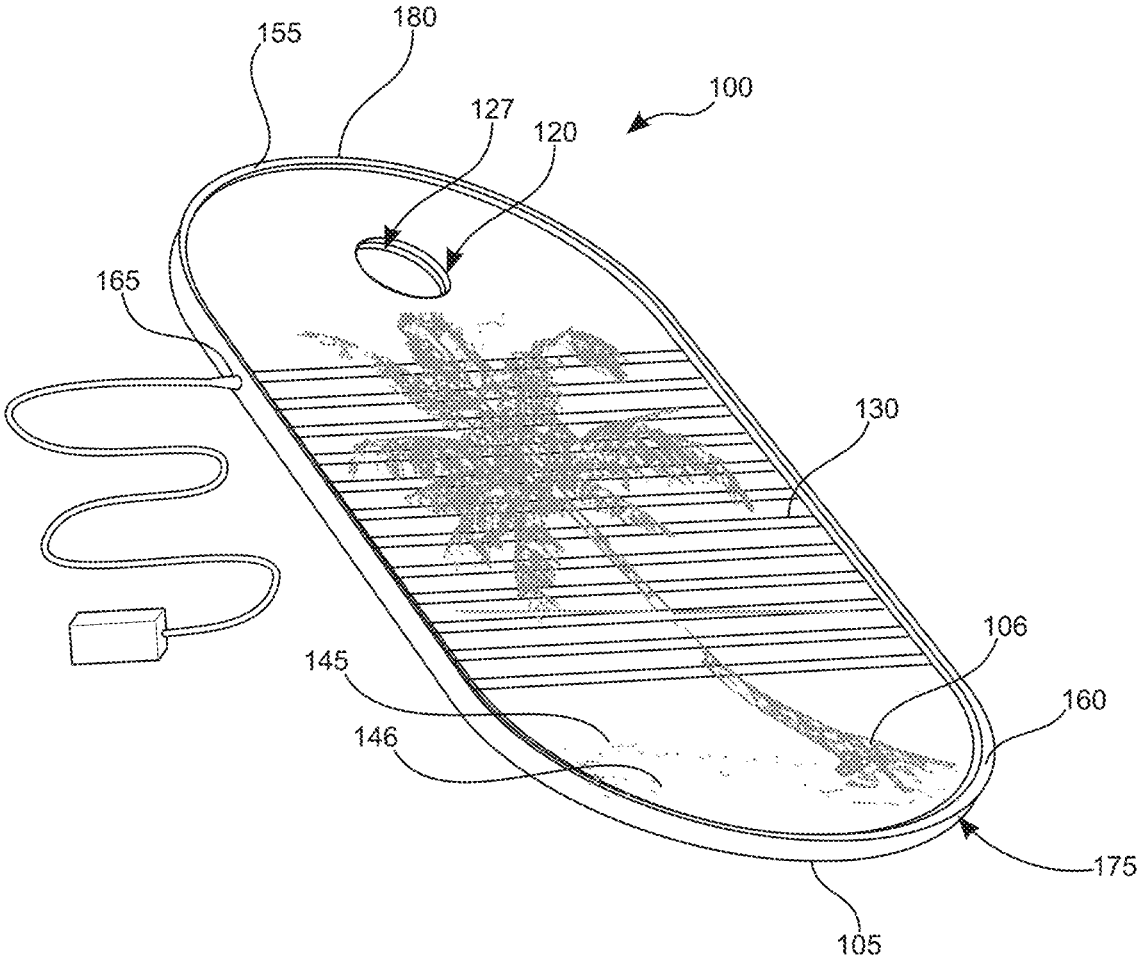
FIG. 1 shows a perspective view illustrating a foot mat according to an embodiment of the present invention.

In greater detail now, referring to the drawings by numerals of reference there is shown in FIG. 1, a perspective view illustrating foot mat 100 according to an embodiment of the present invention.

Foot mat 100 for use in a tub or shower may comprise bottom layer 105 including vibrator member 110 embedded within and adapted to vibrate bottom layer 105, embedded power source 115 that is electrically connected to and adapted to power vibrator member 110, aperture 120 adapted to allow water to pass therethrough, top surface 106 including first connector member 107, and bottom surface 108 adapted to releasable engage with a surface of the tub or shower. Bottom layer 105 is sized and shaped and adapted to be releasable engaged with the surface of the tub or shower and to allow water to pass through aperture 120 and into a drain hole.

Figure 2:
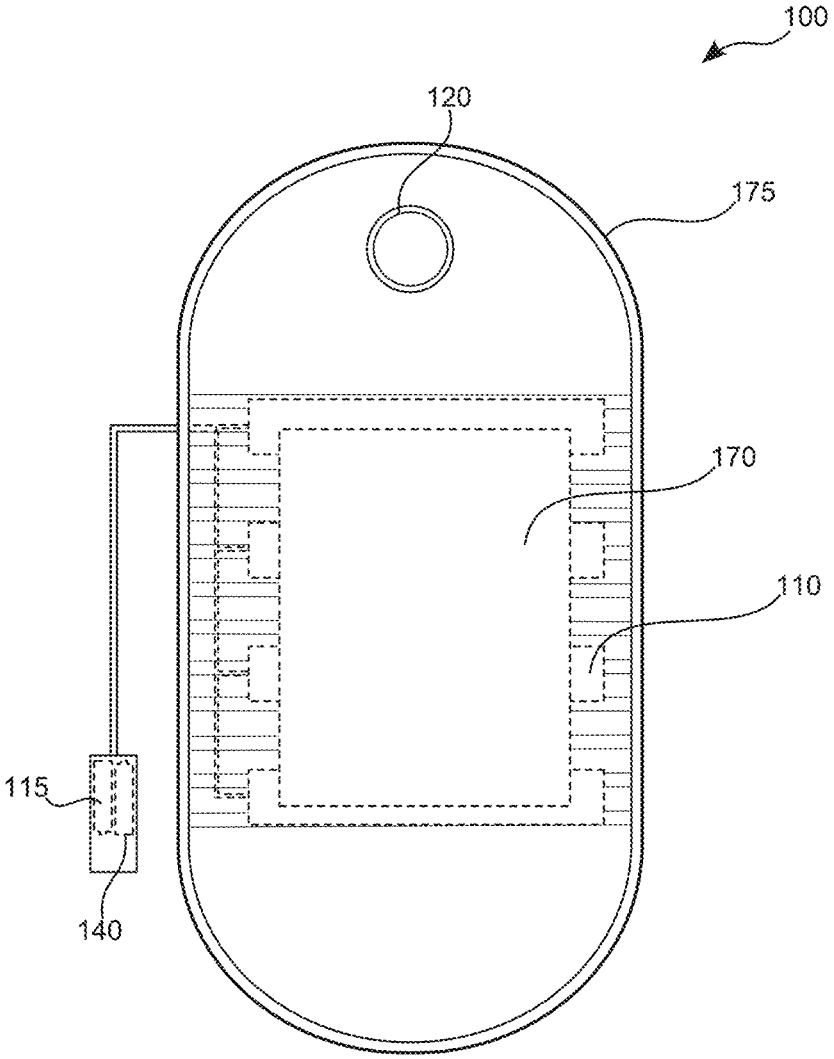
FIG. 2 is a perspective view illustrating the foot mat according to an embodiment of the present invention of FIG. 1.

Referring now to FIG. 2, is a perspective view illustrating foot mat 100 according to an embodiment of the present invention of FIG. 1.

Top layer 125 includes top surface 126 including ridges 130 thereon adapted to provide friction between top surface 126 and a user's feet, and aperture 120 therethrough adapted to align with aperture 120 of bottom layer 105 and allow water to pass therethrough. Bottom surface 128 includes second connector member 129 adapted to releasable connect with first connector member 107 of bottom layer 105 and top layer 125 is adapted to removable connect with and cover bottom layer 105.

The first and second connector members 129 may be formed from respective hook and loop material 135. Top layer 125 may be formed from sponge material 145 but may be formed from loofah material 146 in alternate embodiments. Bottom surface 108 of bottom layer 105 includes at least one suction cup 150 thereon adapted to releasable engage with the surface of the tub or shower. Top layer 125 and bottom layer 105 are formed from a waterproof material.

Figure 3:
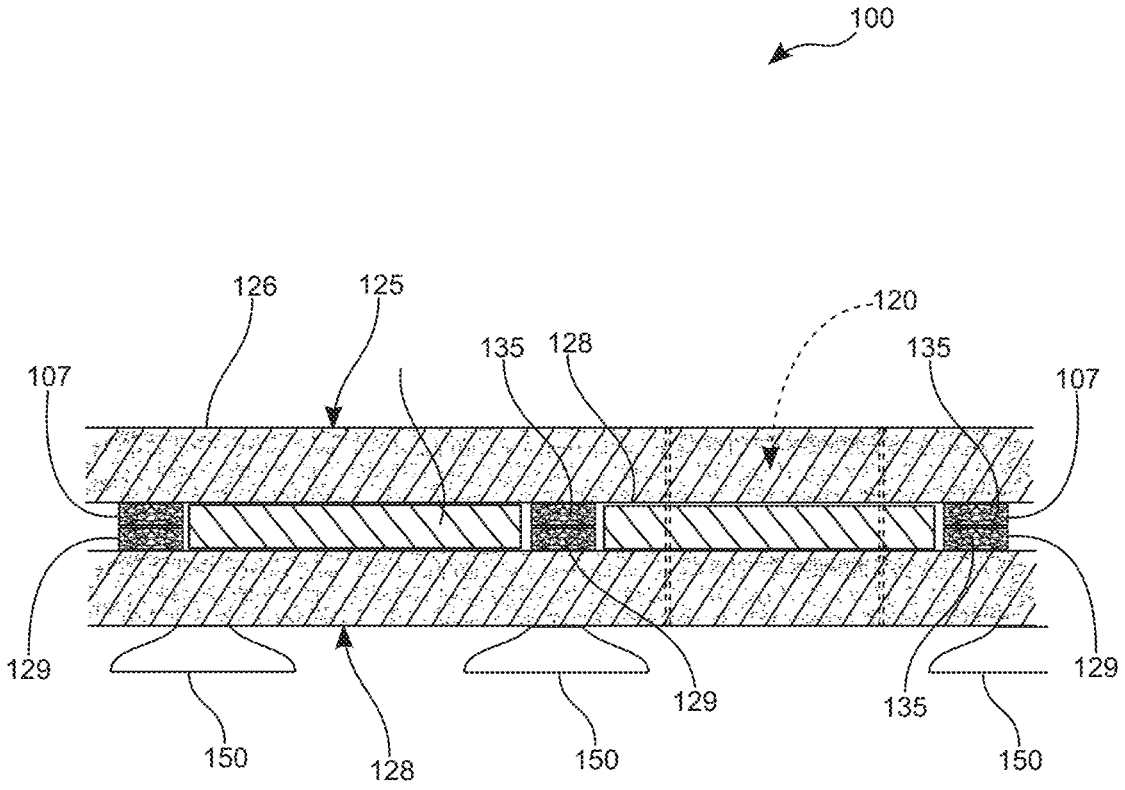
FIG. 3 is a perspective view illustrating foot mat according to an embodiment of the present invention of FIG. 1.

Referring now to FIG. 3, is a perspective view illustrating foot mat 100 according to an embodiment of the present invention of FIG. 1.

Top layer 125 further includes back edge portion 155 extending upwards therefrom and including a material adapted to create friction between back edge portion 155 and a user's foot, such that back edge portion 155 is adapted to scrape layers of dirt or loose skin flakes from the user's foot. The material of back edge portion 155 may be pumice stone 160.

Power source 115 may be formed as rechargeable batteries 140 and bottom layer 105 may include power supply port 165 electrically connected to rechargeable batteries 140 and adapted to releasable connect to an external power source 115. Bottom layer 105 further includes pressure sensor member 170 embedded therein and electrically connected between vibrator member 110 and power source 115 and is adapted to automatically turn on or off vibrator member 110 when a user is standing upon foot mat 100.

The top layer and bottom layer 105 may be formed from rubber and the first and second connector members 129 may be formed from magnets. The top layer and bottom layer 105 are formed having curved portion 175 on respective proximal edges and on respective distal edges 180 thereof in proximity to the respective apertures 120.

Foot mat 100 may be manufactured and provided for sale in a wide variety of sizes and shapes for a wide assortment of applications. Upon reading this specification, it should be appreciated that, under appropriate circumstances, considering such issues as design preference, user preferences, marketing preferences, cost, structural requirements, available materials, technological advances, etc., other kit contents or arrangements such as, for example, including more or less components, customized parts, different color combinations, parts may be sold separately, etc., may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A foot mat for use in a tub or shower, comprising:

a bottom layer including:

a vibrator member embedded therein and adapted to vibrate said bottom layer;

a power source embedded therein, electrically connected to and adapted to power said vibrator member;

an aperture therethrough adapted to allow water to pass therethrough;

a top surface including a first connector member; and a bottom surface adapted to releasably engage with a surface of said tub or shower;

wherein said bottom layer is sized and shaped and adapted to be releasably engaged with said surface of said tub or shower and allow water to pass through said aperture and into a drain hole thereof; and a top layer including:

a top surface including ridges thereon adapted to provide friction between said top surface and a user's feet;

an aperture therethrough adapted to align with said aperture of said bottom layer and allow water to pass therethrough; and a bottom surface including a second connector member adapted to releasably connect with said first connector member of said bottom layer;

wherein said top layer is adapted to removably connect with and cover said bottom layer.

2. The foot mat of claim 1, wherein said first and second connector members are formed from respective hook and loop material.

3. The foot mat of claim 1, wherein said power source is formed as rechargeable batteries.

4. The foot mat of claim 3, wherein said bottom layer further includes a power supply port electrically connected to said rechargeable batteries and adapted to releasably connect to an external power source.

5. The foot mat of claim 1, wherein said top layer is formed from a sponge material.

6. The foot mat of claim 1, wherein said top layer is formed from a loofah material.

7. The foot mat of claim 1, wherein said bottom surface of said bottom layer includes at least one suction cup thereon adapted to releasably engage with said surface of said tub or shower.

8. The foot mat of claim 1, wherein top layer and said bottom layer are formed from a waterproof material.

9. The foot mat of claim 8, wherein said top layer and said bottom layer are formed from rubber.

10. The foot mat of claim 1, wherein said top layer further includes a back edge portion extending upwards therefrom and including a material adapted to create friction between said back edge portion and a user's foot, such that said back edge portion is adapted to scrape of layers of dirt or skin from said user's foot.

11. The foot mat of claim 10, wherein said material of said back edge portion is pumice stone.

12. The foot mat of claim 1, wherein said bottom layer further includes a pressure sensor member embedded therein and electrically connected between said vibrator member and said power source and is adapted to automatically turn on or off said vibrator member when a user is standing upon said foot mat.

13. The foot mat of claim 1, wherein said first and second connector members are formed from magnets.

14. The foot mat of claim 1, wherein said top layer and said bottom layer are formed having a curved portion on respective proximal edges thereof in proximity to said respective apertures.

15. The foot mat of claim 14, wherein said top layer and said bottom layer are formed having a curved portion on respective distal edges thereof.

* * * * *